US005815060A

United States Patent [19]

Matsumoto et al.

[11] Patent Number: 5,815,060

[45] Date of Patent: Sep. 29, 1998

[54] INDUCTANCE ELEMENT

[75] Inventors: Norio Matsumoto, Sodegaura; Takashi Matsuoka, Tokyo; Takehiko Omi, Sodegaura, all of Japan

[73] Assignee: Mitsui Petrochemical Industries, Ltd., Tokyo, Japan

[21] Appl. No.: 348,895

[22] Filed: Nov. 25, 1994

[30] Foreign Application Priority Data

Nov. 25, 1993 [JP] Japan ..... 5-295700
Nov. 24, 1994 [JP] Japan ..... 6-313980

[51] Int. Cl.[6] ..... H01H 71/10

[52] U.S. Cl. ..... 336/175; 336/90

[58] Field of Search ..... 336/208, 175, 336/177, 200

[56] References Cited

U.S. PATENT DOCUMENTS

| | | | |
|---|---|---|---|
| 1,857,215 | 5/1932 | Ruder | 336/20 |
| 4,637,843 | 1/1987 | Takayama et al. . | |
| 4,823,103 | 4/1989 | Nakagawa et al. | 336/175 |
| 4,904,972 | 2/1990 | Ikeda | 336/69 |
| 5,062,197 | 11/1991 | Charles | 336/233 |
| 5,200,730 | 4/1993 | Masuda et al. | 336/175 |
| 5,321,373 | 6/1994 | Shusterman | 336/175 |
| 5,455,552 | 10/1995 | Metsler | 336/65 |

FOREIGN PATENT DOCUMENTS

| | | |
|---|---|---|
| 56-96812 | 8/1981 | Japan . |
| 4-217307 | 8/1992 | Japan . |

OTHER PUBLICATIONS

"Ferrite Beads, balun & broadband cores", Power Converters vol. 6, No. 4, pp. 44–50, Jul.–Aug. 1980.

*Primary Examiner*—Lincoln Donovan

[57] ABSTRACT

To realize compactness of an inductance element such as choke coil or the like, an inductance element is provided which is composed of a magnetic core having a central hollow portion defined by a magnetic alloy thin strip, and a lead line disposed to pass through the hollow portion of the magnetic core. A specific magnetic permeation $\mu$ of said magnetic core is in the range of 100 to 10,000.

19 Claims, 4 Drawing Sheets

INDUCTANCE ELEMENT

BACKGROUND OF THE INVENTION

In, for example, a switching power supply for controlling a large amount of current in a high frequency range, a choke coil has been conventionally used for converting an AC current to a DC current or to interrupt a high frequency component from a DC current or an AC current of a low frequency.

On the other hand, the field to which a switching power supply may be applied has been expanded due to a tendency that bodies of electronic equipment are small in size and thinner and thinner. In order to meet this requirement and to make thin the switching power supply itself, choke coils or the like which are components of the switching power supply have to be made small in size and thin.

For instance, in order to reduce the height of an article to half an inch, a part or component, to constitute it, that has a height (or length) of 10 mm or less is required in view of clearance. In other words, magnetic parts of this type such as transformers, choke coils and the like have not yet been made satisfactorily low in height, and in particular, in a field where an electric power of 10 W or more is used, there have not been such compact components.

Furthermore, for the purpose of enhancing a heat radiation efficiency of the circuit, there is a demand to thin the overall physical size of the circuit.

Under such a circumstance, a thin type magnetic component such as a thin type choke coil has been realized utilizing a feature that ferrite magnetic powder may be molded or formed into a desired shape.

However, since a saturated magnetic flux density of the ferrite magnetic material is low in comparison with that of a metallic magnetic material, the satisfactory compactness has not always been attained by the ferrite magnetic material in comparison with the choke coils which are made of different magnetic material, respectively, with the same performance.

In view of this point or the like, public attention has been paid to a technique to obtain a compact choke coil in which a thin strip made of amorphous magnetic alloy or crystallite magnetic alloy having a much higher saturated magnetic flux density than that of the ferrite magnetic material is used.

For producing such an element, a magnetic alloy thin strip having a predetermined strip width is wound to obtain a toroidal shaped magnetic core having a hollow central portion with a predetermined inside diameter, and is subjected to a suitable heat treatment. Then, the core is received in a resin case or coated with a resin coating. Then, a winding is effected to its thin strip wound portion by a predetermined number of turns.

By the way, it should be noted that, as mentioned above, since the amorphous magnetic alloy and crystallite magnetic alloy have a higher saturated magnetic flux density than that of the conventional ferrite, it is possible to obtain a compact choke coil by these materials in comparison with the ferrite.

Since the magnetic core of the coil is obtained by winding the above-described magnetic alloy thin strip, in the case where the coil is constructed so that a lead line intersects with the toroidal magnetic core, it is necessary to decrease a width of the thin strip in order to reduce a height of the magnetic core.

However, the reduction of the width of the magnetic alloy thin strip makes it very difficult to wind the strip. Namely, since the width of the thin strip is decreased, a tension resistance of the thin strip is decreased. When the thin strip is subjected to a predetermined tension to be wound around the axial center, there is a high fear that the thin strip would be drawn and cut.

Also, the present inventors has found that even if a thickness of the case or coating resin would be reduced or the width of the thin strip would be decreased in consideration of a thickness of the winding, there is a little effect for thinning the overall choke coil.

In view of the foregoing tasks, an object of the present invention is to realize the compactness of an inductance element such as a choke coil of this type.

SUMMARY OF THE INVENTION

The present invention relates to an inductance element, and more particularly to an inductance element which is suitable for a choke coil or the like to be used for smoothing a current in a switching power supply and interrupting a high frequency component.

According to the present invention, an inductance element is composed of a magnetic core made by winding a magnetic alloy thin strip with a hollow portion along its centerline and a lead line disposed to penetrate the central portion of the magnetic core. A relative permeability $\mu$ of said magnetic core is in the range of 100 to 10,000.

It is preferable that a saturated magnetic flux density $B_s$ of the magnetic alloy thin strip be equal to or greater than 0.6 T(Tesla).

It is preferable to select the relationship among the saturated magnetic flux density $B_s$,(T) the relative permeability $\mu$, the outside diameter $\phi_o$(m) and the inside diameter $\phi_i$(m) of the magnetic core to meet the following formula:

$$0<B_s\phi_o/\mu\phi_i^2\leqq 10$$

It is also preferable to use a thin strip of Fe-based amorphous alloy or Fe-based crystallite alloy as the magnetic alloy thin strip.

The "hollow portion" means a space portion formed in a central axial portion by winding the magnetic alloy thin strip, and also comprises the case where resin or the like is filled in the spaced portion and the lead line is caused to pass through the resin. Furthermore, the present invention includes devices which have a spacer made of ceramics and may be inserted into the spaced portion and the lead line may be inserted into the spacer.

Also, in the present invention, the magnetic alloy thin strip may be wound directly around the lead line to form a magnetic core. In summary, it is sufficient that the lead line is inserted into the magnetic alloy thin strip wound in a final article condition.

Furthermore, when the magnetic alloy thin strip is wound relative to the lead line, a dummy tape may be provided at a portion from which the winding of the magnetic alloy thin strip is started.

Incidentally, it is preferable that a resistance of the lead line be equal to or less than 20 $\mu\Omega$cm, and more preferably, it is not greater than 2 $\mu\Omega$cm.

An example of the amorphous magnetic alloy which is used as the thin strip in manufacturing the inductance element according to the present invention may be as follows:

$$M_{100-a}M'_a$$

where M is at least one element selected from the group consisting of Fe and Co, M' is at least one element selected from the group consisting of B, Si, C and Cr, and a is atomic percentage which is not smaller than 4 but not larger than 40 or the Fe-based amorphous magnetic alloy.

The Fe-based amorphous magnetic alloy is more preferably in the present invention.

In particular, the amorphous magnetic alloy represented by the following formula is more preferable as the amorphous magnetic alloy which is used as the thin strip in manufacturing the inductance element in the present invention, $$Fe_xSi_yB_zM_w$$

where M is at least one element selected from the group consisting of Co, Ni, Nb, Ta, Mo, W, Zr, Cu, Cr, Mn, Al, P, C and the like, and x, y, z and w which means atomic percentages, and which are values that meet the relationships, $0 \leqq x \leqq 85$, $5 \leqq y \leqq 15$, $5 \leqq z \leqq 25$, and $0 \leqq w \leqq 10$, respectively.

The amorphous thin strip made of these alloys may be adjusted in a desired composition and a desired thin strip shape by a method which is so called the method of rapidly querching from the melt. Also, usually, it is possible to improve the various characteristics by applying a suitable heat treatment thereto at a temperature that is not lower than a Curie temperature and not higher than a crystalline temperature.

Also, it is possible to exemplify nano-crystalline (fine-crystalline) magnetic alloy that constitutes the thin strip used in manufacturing the inductance element according to the present invention, for example as follows.

$$(Fe_{1-a}M_a)_{100-x-y}M'_xM''_y$$

where M is at least one selected from the group consisting of Co and Ni, M' is at least one element selected from the group consisting of Si, B, Ga, Nb, Mo, Ta, W, Ti, Zr, Cr, Mn and Hf, M" is at least one element selected from the group consisting of Cu and Al, and a, x and y are values that meet the relationships, $0 \leqq a \leqq 0.5$, $0 \leqq x \leqq 50$ and $0 \leqq y \leqq 10$ (where x and y are atomic percentages), respectively.

The microcrystal alloy especially shown by an undermentioned general type is desirable in the above-mentioned alloy.

$$(Fe_{1-a}M_a)_{100-x-y-z-\alpha-\beta}Si_xB_yM'_zAl_\alpha Cu_\beta$$

M is at least one selected from the group consisting of Co, Ni. M' is at least one element selected from group consisting of Ga, Nb, Mo, Ta, W, Ti, Zr, Cr, Mn, Hf. Said a, x, y, z, α, and β are value that meet the relationships as follows,

| | |
|---|---|
| $0 \leqq a \leqq 0.5$, | $0 \leqq z \leqq 25$ |
| $0 \leqq x \leqq 30$, | $0 \leqq \alpha \leqq 10$ |
| $0 \leqq y \leqq 25$, | $0 \leqq \beta \leqq 3$ (more preferably $0.1 \leqq \beta \leqq 3$) |
| $5 \leqq x + y + z \leqq 40$, | $0.1 \leqq \alpha + \beta \leqq 10$ |

(where x, y, z, α and β are the atomic percentages).

It is preferable that a particle diameter of the crystallite of the nano-crystalline alloy be not greater than 500 Å, and more preferably not greater than 200 Å. Also, it is preferable that the crystalline part of the crystallite alloy is not smaller than 30%, and more preferably not smaller than 50%.

The above-described nano-crystalline alloy thin strips may be obtained usually by applying, to the strips which have been once obtained as amorphous alloy strips, a suitable heat treatment at a temperature that is not lower than the crystallization temperature. Also, it is possible to improve the various magnetic characteristics (for example, permeability, iron loss or current superposition) by changing the conditions for the heat treatment.

It is also possible to improve the magnetic various characteristics (for example, permeability or iron loss in high frequency) by accumulating dielectric powder such as MgO, $SiO_2$, and $Sb_2O_5$ on surfaces of the thin strips on one side or both sides so as to insulating the laminated surfaces of the winding of the thin strips from each other.

The magnetic core of the inductance element of the present invention is produced by winding the thus obtained thin strips. First of all, the strips which have a predetermined width and a predetermined thickness are wound around a core member having a predetermined shape. The cross-section of the core member may be circular or any other polygonal shapes such as a rectangular shape.

At the time when the thickness of the thin strip winding portion reaches a predetermined level, the winding operation of the thin strips is terminated. Then, a treatment for fixing the winding end portion of the thin strips to the magnetic core by using a highly viscous resin tape having a heat resistance such as a polyimido (trade name:Kapton produced by Dupon chemical co.,) tape or by spot-welding is effected so as to prevent the wind-back.

Then, the lead line is inserted into the magnetic core from which the core member has been removed. In this case, by using the lead line as the core member, it is possible to readily obtain an integral assembly composed of the magnetic core and the lead line. Furthermore, it is possible to dispense with the work to remove the separate core member. This makes it possible to reduce the manufacture cost and the number of the components.

Aluminum, aluminum alloy, copper, copper alloy, iron alloy or plated surface of it for the oxidation prevention. Sn-plated copper wire or annealed Sn-plated copper wire, solder plated copper wire, 42 alloy wire, and CP wire, etc. are enumerated as a concrete example. Especially, the Sn-plated copper wire of the low resistance rate is desirable in the example of the description above.

Incidentally, for the lead line, it is possible to arrange a plurality of conductive wires each having the same or different cross-section in bundle along the centerline of the magnetic core. In the case where the plurality of conductive wires are insulated from each other (i.e., lead lines insulated by coatings or ceramic tubes), the conductive wires may be wound in the longitudinal direction on the side wall of the magnetic core to be used as a winding.

Subsequently, the magnetic core on which the thus obtained lead line has been mounted is subjected to a heat treatment (for controlling the magnetic characteristics of relative permeability, for example). Incidentally, it is possible to mount the lead line after the heat treatment. Under the conditions of the heat treatment, preferably, in order to keep the thin strips in an amorphous state, the temperature is not lower than the Curie temperature but not higher than the crystallization temperature, and in order to keep the thin strips in a nano-crystalline state, the temperature is not lower than the crystallization temperature. A period of the heat treatment is preferably ranged from 30 minutes to 24 hours. Incidentally, in this case, it is possible to adjust the various characteristics to desired ones by effecting the heat treatment while applying a magnetic field of 0 to 60 kA/m (for example, 5 kA/m) in a width direction of the thin strip, using as an ambient atmosphere an oxidizing gas such as nitrogen ($N_2$) or Argon (Ar), a reducing gas or an inert gas, or applying a force to the magnetic core in a constant direction.

Thereafter, the magnetic core is encased in a case or is subjected to an insulation with resin (for example, epoxy resin, polyester resin, or silicon resin) coatings for obtaining the inductance element according to the present invention.

In the element of the present invention, for obtain the good characteristic of current superposition, the relative permeability p of the magnetic core at an original point on a magnetizing curve at 100 kHz has to meet the following relationship:

$$100 \leqq \mu \leqq 10{,}000$$

Inductance element of the present invention is used as smoothing choke coil, a choke coil for an alternating current line, choke coil for an active filter, choke coil for switching converter or noise reduction element and the like.

Now, it is preferable that, in order to obtain a good superposition characteristic in case of a smoothing choke coil or a choke coil for an alternating current line, a choke coil for an active filter, and/or a choke coil for a switching converter the relative permeability $\mu$ of the magnetic core meet the relationship:

$$100 \leqq \mu \leqq 2{,}000.$$

More preferably, by adjusting the heat treatment conditions so that the specific magnetic permeation $\mu$ meet the relationship, $$500 \leqq \mu \leqq 2{,}000,$$

the current superposition characteristic becomes more excellent.

On the other hand, it is preferable that, in order to obtain a satisfactory noise reduction performance in case of a noise reduction element, the relative permeability $\mu$ of the magnetic core meet the relationship:

$$5{,}000 \leqq \mu \leqq 10{,}000.$$

Incidentally, the relative permeability $\mu$ means a value obtained by dividing the permeability $\mu_i$ by the vacuum permeability $\mu_0$.

On the other hand, the compactness of the magnetic components largely depends upon the saturated magnetic flux density. Namely, assuming that the relative permeability $\mu$ is kept constant up to the saturated magnetic flux density $B_s$, the following relation between the electric capacitance E of the magnetic component and the volume V of the magnetic core is given:

$$E \propto (B_s)V/(\mu)$$

In order to obtain the compact magnetic component which has been widely and generally used and which has a larger capacity than that of the ferrite magnetic material, it is preferable that the saturated magnetic flux density of the magnetic alloy thin strip be not smaller less than 0.6 T.

In this invention, when designing the outer diameter $\phi_o$(m:meter) and inner diameter $\phi_i$(m) of magnetic core, the saturation magnetic flux density Bs (T:tesla), $\phi_o$, $\phi_i$, relative permeability $\mu$, vacuum permeability $\mu_o$ ($4\pi\times10^{-7}$H/m) and maximum electric current density $\sigma$ of lead wire will fill the following relational expression is desirable.

$$Bs\phi_o/\mu\mu_0 \leqq \sigma\phi_i^2/4$$

Large capacity and small magnetic parts are obtained by designing the element which satisfies the above-mentioned relational expression.

Said relational expression is transformed as follows:

$$B_s\phi_o/\mu\phi_i^2 \leqq \mu_o\sigma/4$$

Also, in consideration of the conditions for realizing the magnetic core, i.e., $\phi_o$, $\phi_i>0$, the following condition is given:

$$0<B_s\phi_o/\mu\phi_i^2 \leqq \mu_o\sigma/4$$

The present inventors have found that, in order to suppress the amount of heat generated in the element, it is preferable that the current density $\sigma$ be not greater than $\sigma=100/\pi\times10^6$A/m$^2$ (about $32\times10^6$A/m$^2$). Accordingly, by the substitution of $\sigma=100/\pi\times10^6$A/m$^2$, the following relation is obtained among the saturated magnetic flux density $B_s$ of the magnetic core, the relative permeability $\mu$, the outside diameter $\phi_o$(m) and the inside diameter $\phi_i$(m) of the magnetic core:

$$0<B_s\phi_o/\mu\phi_i^2 \leqq 10$$

According to the present invention, the element meets the relation, i.e., $0<B_s\phi_o/\mu\phi_i^2 \leqq 10$, and more preferably meets the relation, i.e., $0.1 \leqq B_s\phi_o/\mu\phi_i^2 \leqq 10$ where $B_s$(T) is the saturated magnetic flux density of the magnetic core, $\mu$ is the relative permeability, $\phi_o$(m) is the outside diameter of the magnetic core and $\phi_i$(m) is the inside diameter of the magnetic core, whereby it is possible to obtain an element which suffers from a less temperature elevation even if it is made compact as an actual element.

Also, it is preferable that the resistance of the lead line to be used in the present invention be not greater than 20 $\mu\Omega$cm, and more preferably not greater than 2 $\mu\Omega$cm. Namely, if the resistance of the lead line is not greater than 20 $\mu\Omega$cm, it is advantageous that the temperature elevation is suppressed. Furthermore, if the resistance of the lead line is not greater than 2 $\mu\Omega$cm, it is further advantageous that the temperature elevation is further suppressed.

The inductance element may be encased in a case made of non-magnetic material such as synthetic resin or aluminum or otherwise may be sealed by epoxy resin or the like. It is possible to enhance the heat radiation characteristics by providing fins, which are made of non-magnetic material such as aluminum, to the outside of the package, i.e., case in the case where the outer configuration of the package is in the form of fins or the package is made of synthetic resin.

Polyamide (nylon), modified polyamide (Trade Name: ARLEN made by Mitsui Petrochemical Co., Ltd.), PBT (polybutylene terephthalate), PET (polyethylene terephthalate), PPS (polyphenylene sulfide) and PP (polypropylene) etc. can be mentioned as plastic which can be used as a material of the case.

Furthermore, it is possible to obtain elements having difference inductance and current by connecting a plurality of thus obtained inductance elements in parallel or in series with each other. In this case, it is possible to obtain versatile elements with a uniform outer appearance without changing a height of the element, for example, by sealing the elements with epoxy resin or the like to form the package in a single assembled element unit after arranging the individual inductance elements in parallel.

Incidentally, these inductance elements may be encased in a case made of synthetic resin to form a single assembled element. In case of such an assembled element, since the heat generation amount is also increased, the outer appearance of the case should be in the form of fins or the non-magnetic material such as aluminum should be disposed outside the package to thereby obtain the inductance assembly unit that is superior in heat radiation property.

Of a method for connecting the plurality of elements, it is possible to encase the elements that have been connected in advance or to seal them by epoxy resin, or otherwise to connect the elements by utilizing a print wiring or the like on the actually installed substrate.

It is possible to handle or use the elements according to the present invention in the same way as for the various elements such as a capacitance, a resistor and the like. Because no-winding in the element itself, the elements according to the present invention are easy to handle and compact in size.

DESCRIPTION OF THE PREFERRED EMBODIMENTS

The present invention will now be described with reference to the accompanying drawings.

Figure 1:
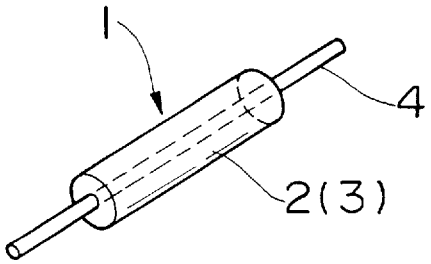
FIG. 1 is a perspective view showing an inductance element according to the present invention.
Figure 2:
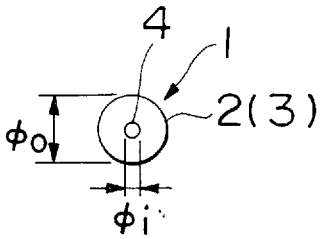
FIG. 2 is a cross-sectional view showing the inductance element according to the present invention.
Figure 3:
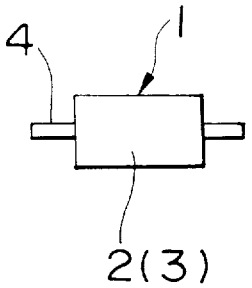
FIG. 3 a front view showing the inductance element according to the present invention.

As shown in FIG. 1, according to the present invention, a magnetic core 2 for an inductance element 1 is manufactured by winding a thin strip 3 which has been obtained as mentioned above. First of all, the thin strip that has a predetermined width and a predetermined thickness is wound around a core member (not shown) having a preselected shape. The cross-section of the core member is not limited to a circular shape but may be rectangular or polygonal.

At the time when the thickness of the wound portion of the thin strip reaches a predetermined level, the winding operation of the thin strip 3 is terminated. A treatment to fix the wound end portion of the thin strip 3 to the magnetic core 2 by using a highly viscous resin tape having a heat resistance such as a polyimido (Trade name: Kapton) tape or by spot-welding is effected so as to prevent the wind-back.

Figure 7:
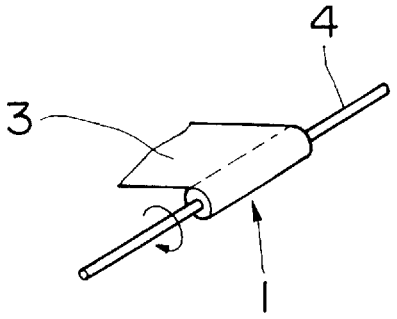
FIG. 7 is a perspective view showing a state in which a thin strip is directly wound on a lead line in the inductance element according to the present invention.

A lead line 4 is inserted into the magnetic core 2 from which the core member has been removed. In this case, as shown in FIG. 7, by directly using the lead line 4 as the core member, it is possible to readily obtain an integral assembly composed of the magnetic core 2 and the lead line 4. Furthermore, it is possible to dispense with the work to remove the separate core member. This makes it possible to reduce the manufacture cost and the number of the components.

Aluminum, aluminum alloy, copper, copper alloy, iron alloy or plated surface of it for the oxidation prevention. Sn-plated copper wire or annealed Sn-plated copper wire, solder plated copper wire, 42 alloy wire, and CP wire, etc. are enumerated as a concrete example. Especially, the Sn-plated copper wire of the low resistance rate is desirable in the example of the description above.

Figure 9:
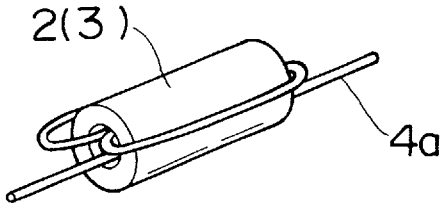
FIG. 9 is a perspective view showing an inductance element representative of a modification of the lead line.

Incidentally, for the lead line 4, it is possible to arrange a plurality of conductive wires 4*a* each having the same or different cross-section in bundle along the centerline of the magnetic core 2. In the case where the plurality of conductive wires are insulated from each other (i.e., lead lines insulated by coatings or ceramic tubes), the conductive wires may be wound in the longitudinal direction on the side wall of the magnetic core to be used as a winding as shown in FIG. 9.

Subsequently, the magnetic core 2 on which the thus obtained lead line 4 has been mounted is subjected to a heat treatment. Incidentally, it is possible to mount the lead line after the heat treatment. Under the conditions of the heat treatment, preferably, in order to keep the thin strips in an amorphous state, the temperature is not lower than the Curie temperature but not higher than the crystallization temperature, and in order to keep the thin strips in a nano-crystalline state, the temperature is not lower than the crystallization temperature. A period of the heat treatment is ranged from 30 minutes to 24 hours. Incidentally, in this case, it is possible to adjust the various characteristics to desired ones by effecting the heat treatment while applying a magnetic field of 0 to 60 kA/m (for example, 5 kA/m) in a width direction of the thin strip, using as an ambient atmosphere an oxidizing gas, a reducing gas or an inert gas, or applying a force to the magnetic core in a constant direction.

Figure 8:
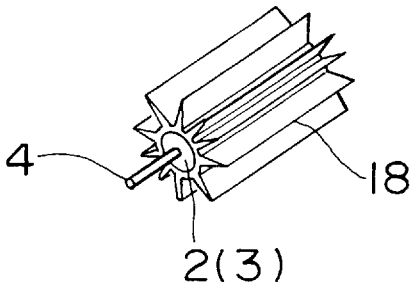
FIG. 8 is a perspective view showing the inductance element according to the present invention, in which a case is made in the form of fins.

The inductance element 1 may be encased in a case made of non-magnetic material such as synthetic resin or aluminum or otherwise may be sealed by epoxy resin or the like. In this case, as shown in FIG. 8, it is possible to enhance the heat radiation characteristics by providing fins, which are made of non-magnetic material such as aluminum, to the outside of the package, i.e., case 18 in the case where the outer configuration of the package is in the form of fins or the package is made of synthetic resin.

Furthermore, it is possible to obtain elements having difference inductance and current by connecting a plurality of thus obtained inductance elements 1 in parallel or in series with each other. In this case, it is possible to obtain versatile elements with a uniform outer appearance without changing a height of the element, for example, by sealing the elements with epoxy resin or the like to form the package 5 in a single assembled element unit 6 after arranging the individual inductance elements 1 in parallel as shown in 4.

Figure 4:
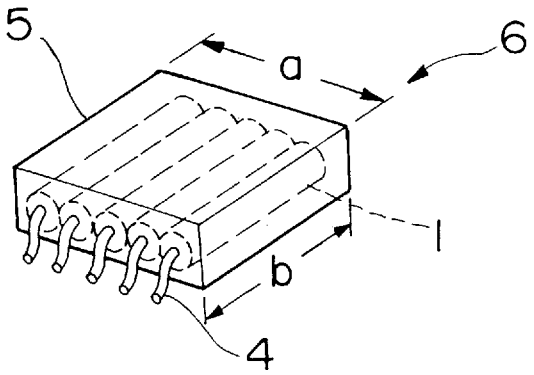
FIG. 4 a perspective view showing an assembled element which is formed by arranging a plurality of inductance elements of the present invention in parallel.

Incidentally, although the plurality of inductance elements 1 are sealed by resin in FIG. 4, these inductance elements 1 may be encased in a case made of synthetic resin to form a single assembled element. In case of such an assembled element, since the heat generation amount is also increased, the outer appearance of the case should be in the form of fins which are similar to those shown in FIG. 8 or the non-magnetic material such as aluminum should be disposed outside the package to thereby obtain the inductance assembly unit that is superior in heat radiation property.

Of a method for connecting the plurality of elements 1, it is possible to encase the elements that have been connected in advance or to seal them by epoxy resin, or otherwise to connect the elements by utilizing a print wiring or the like on the actually installed substrate.

Specific Examples of the present invention and Comparison Example will now be described.

EXAMPLE 1

As shown in FIG. 7, a surface (one sided) of a Fe-based amorphous magnetic alloy thin strip 3 (Trade Name: "Metglas 2605S-2", composition: $Fe_{78}Si_9B_{13}$ (atom %), thickness: 20 $\mu$m, width: 15 mm) made by US Allied-signal Inc. was coated with fine powder of $Sb_2O_5$, and thereafter, the strip was wound around a lead line 4 which annealed Sn-plated copper wire (resistivity: 0.97 $\mu\Omega$cm) having a diameter of 1.6 mm to form an element 1 having an inner diameter of 1.6 mm, an outer diameter of 5 mm and a length of 15 mm.

The winding end was fixed by polyimido tape (Kapton tape). This was exposed in an $N_2$ atmosphere and heated at a temperature that was not lower than Curie temperature and not higher than crystallization temperature. Specifically, the condition of heat treatment was 430° C. for 2 hours.

Five elements each of which was produced as described above were arranged in parallel and sealed by epoxy resin 5 to form a package body, and terminals (lead lines 4) were projected from one side of the package body so as to be mountable on the print circuit board, thus producing an assembled element 6. The outer appearance thereof is shown in FIG. 4.

The terminals were electrically short-circuited so that the five elements 1 were connected in series in the package body, and the current superposition characteristic of the inductance was measured at a frequency of 100 kHz.

EXAMPLE 2

As shown in FIG. 7, a Fe-based amorphous magnetic alloy thin strip (Trade Name: "Metglas 2605S-2", composition: $Fe_{78}Si_9B_{13}$ (atom %), thickness: 20 $\mu$m, width: 15 mm) made by US Allied-signal Inc. was wound around a winding core having a diameter of 1.6 mm, and after the completion of the winding, the end portion was fixed by spot-welding. Thereafter, the winding core was removed. After that, the magnetic core which having an inner diameter of 1.6 mm, an outer diameter of 5 mm and a length of 15 mm was obtained. This was exposed in an $N_2$ atmosphere and heated at a temperature that was not lower than Curie temperature and not higher than crystallization temperature. Specifically, the condition of heat treatment was 430° C. for 2 hours.

An annealed Sn-plated copper wire (resistivity: 0.89 $\mu\Omega$cm) that had been shaped into a U-letter in advance was inserted into the article and was reshaped into a lead line 14 by a pressing machine.

Figure 11:
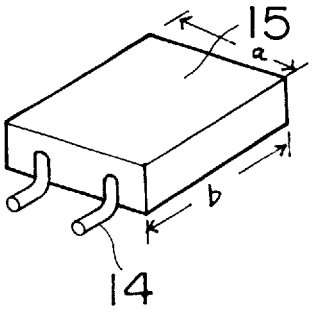
FIG. 11 is a perspective view showing an outer appearance of an assembled element according to an example 2 of the present invention.
Figure 12:
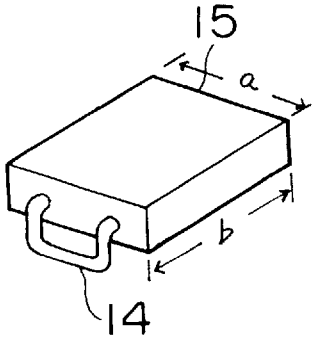
FIG. 12 is a perspective view showing an outer appearance of an assembled element according to a modification of the example 2 of the present invention.

The produced article was encased in a case 15 made of modified polyamide (Trade Name: ARLEN) made by Mitsui Petrochemical Co., Ltd. and the case 15 are fixed to each other with epoxy system adhesives. The outer appearance is shown in FIGS. 11 and 12.

COMPARISON EXAMPLE

Figure 5:
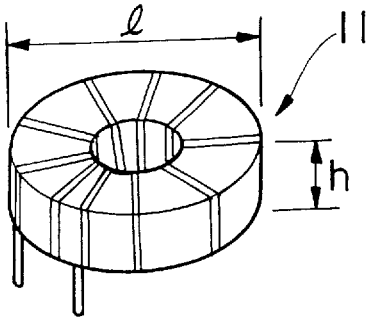
FIG. 5 is a perspective view showing a toroidal choke coil according to a comparison example.
Figure 6:
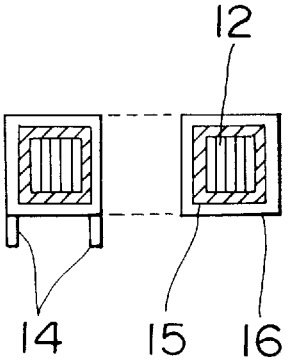
FIG. 6 is a cross-sectional view showing the toroidal choke coil according to the comparison example.

On the other hand, in comparison, a toroidal choke coil 11 (TM coil 6 $\mu$H-10A) having the same rated capacitance was produced as shown in FIGS. 5 and 6.

In the same manner as in Example 1, a surface (one sided) of a Fe-based amorphous magnetic alloy thin strip (Trade Name: "Metglas 2605S-2", composition: $Fe_{78}Si_9B_{13}$, thickness: 20 $\mu$m, width: 5 mm) made by US Allide-Signal Inc. was wound to a magnetic core 12 having an outside diameter of 21.5 mm and an inside diameter of 12.0 mm. The winding was subjected to a heat treatment and was received in the resin case 15. Thereafter, two lead lines 16 each having a diameter of 1.1 mm were wound in parallel by eight turns about a circumferential direction of the case 15 made of resin. As a result, a toroidal choke 11 having an outside diameter (l) of 27 mm and a height (h) of 12 mm was obtained.

Figure 10:
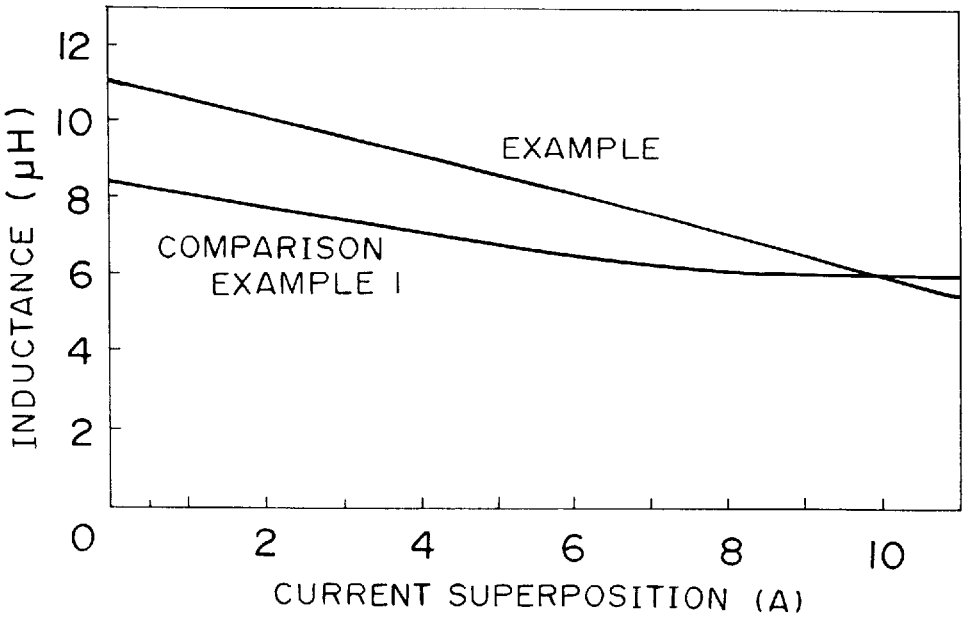
FIG. 10 is a graph showing a current superposition characteristic of an inductance obtained by the embodiment of the present invention and the comparison example.

With respect to this toroidal choke coil, the current superposition characteristic of the inductance at the frequency of 100 kHz was measured (Comparison Example). FIG. 10 shows a change in inductance relative to the superposition current between the Example and the Comparison. The following Table shows the comparison in package dimension between Examples and Comparison.

| | Ex. 1 | Comparison 1 | Ex. 2 |
|---|---|---|---|
| rated capacitance | 6 $\mu$H–10 A | 6 $\mu$H–10 A | 4 $\mu$H–5 A |
| actual dimension | a = 25 mm, b = 20 mm | $\lambda$ = 27 mm | a = 13 mm, b = 20 mm |
| actual height | 6 mm | 12 mm | 7 mm |
| foot print | 500 $mm^2$ | 729 $mm^2$ | 260 $mm^2$ |
| weight | 10 g | 15 g | 5 g |
| relative permeability ($\mu$) | 500 | 250 | 1,000 |
| $B_s$ | 1.56 T | 1.56 T | 1.56 T |
| $\phi_o$ | $5 \times 10^{-3}$ m | | 5.0 mm |
| $\phi_i$ | $1.6 \times 10^{-3}$ m | | 1.6 mm |
| $\sigma$ | $4.97 \times 10^6$ A/$m^2$ | $5.26 \times 10^6$ A/$m^2$ | $4.42 \times 10^6$ A/$m^2$ |
| $B_s\phi_o/\mu\phi_i^2$ | 6.09 | — | 3.05 |
| temperature rise(°C.) in rated current(DC) | 26.2° C. | — | 9.8° C. |

Thus, according to the examples, the foot print was small in comparison with the conventional article, and the actual height was about half of the conventional article.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An inductance element, comprising:

a magnetic core formed by winding a magnetic alloy thin strip, which is made of Fe-based amorphous alloy, said magnetic core having a hollow portion in the vicinity of a center; and a lead line disposed to pass through the hollow portion of said magnetic core;

wherein a relative permeability $\mu$ of said magnetic core is in the range of 100 to 10,000.

2. The inductance element according to claim 1, wherein the lead line is used as a core member and the magnetic alloy thin strip is wound directly around said core member.

3. The inductance element according to claim 1, wherein the lead line is a Sn-plated copper wire.

4. An assembled unit wherein a plurality of inductance elements each of which is recited as in claim 1, are arranged in parallel, each magnetic core portion is sealed by resin to form a package, and the lead line of each inductance element is projected from a side wall of said package.

5. The assembled unit according to claim 4, wherein a case made of non-magnetic material is used for the package instead of the resin sealing.

6. The assembled unit according to claim 4, wherein a case made of non-magnetic material is a modified polyamide for the package.

7. The inductance element according to claim 1, wherein the Fe-based amorphous alloy has the following formula:

$$Fe_xSi_yB_zM_w$$

wherein M is at least one element selected from the group consisting of Co, Ni, Nb, Ta, Mo, W, Zr, Cu, Cr, Mn, Al, P and C, and x, y, z and w are atomic percentages and satisfy the following relationships, $0 \leqq x \leqq 85$, $5 \leqq y \leqq 15$, $5 \leqq z \leqq 25$, and $0 \leqq w \leqq 10$, respectively.

8. The inductance element according to claim 1, wherein said thin strip is in one sheet.

9. An inductance element, comprising:

a magnetic core formed by winding a magnetic alloy thin strip, which is made of Fe-based nano-crystalline alloy, said magnetic core having a hollow portion in the vicinity of a center; and a lead line disposed to pass through the hollow portion of said magnetic core;

wherein a relative permeability $\mu$ of said magnetic core is in the range of 100 to 10,000.

10. The inductance element according to claim 9, wherein the Fe-based nano-crystalline alloy has the following formula:

$$(Fe_{1-a}M_a)_{100-x-y}M'_xM''_y$$

wherein M is at least one element selected from the group consisting of Co and Ni, M' is at least one element selected from the group consisting of Si, B, Ga, Nb, Mo, Ta, W, Ti, Zr, Cr, Mn and Hf, M" is at least one element selected from the group consisting of Cu and Al, and a, x and y satisfy the following relationships, $0 \leqq a \leqq 0.5$, $0 \leqq x \leqq 50$ and $0 \leqq y \leqq 10$ (where x and y are atomic percentages), respectively.

11. The inductance element according to claim 9, wherein the Fe-based nano-crystalline alloy has the following formula:

$$(Fe_{1-a}M_a)_{100-x-y-z-\alpha-\beta}Si_xB_yM'_zAl_\alpha Cu_\beta$$

wherein M is at least one element selected from the group consisting of Co and Ni, M' is at least one element selected from group consisting of Ga, Nb, Mo, Ta, W, Ti, Zr, Cr, Mn and Hf, and a, x, y, z, $\alpha$, and $\beta$ satisfy the following relationships:

| | |
|---|---|
| $0 \leqq a \leqq 0.5$ | $0 \leqq z \leqq 25$ |
| $0 \leqq x \leqq 30$ | $0 \leqq \alpha \leqq 10$ |
| $0 \leqq y \leqq 25$ | $0 \leqq \beta \leqq 3$ (more preferably $0.1 \leqq \beta \leqq 3$) |
| $5 \leqq x + y + z \leqq 40$ | $0.1 \leqq \alpha + \beta \leqq 10$ |

(where x, y, z, $\alpha$, and $\beta$ are atomic percentages).

12. The inductance element according to claim 11, wherein the particle diameter of the crystallite of the nano-crystalline alloy is not greater than 500 Å.

13. The inductance element according to claim 11, wherein the crystalline part of the crystallite alloy is not smaller than 30%.

14. The inductance element according to claim 9, wherein said thin strip is in one sheet.

15. An inductance element, comprising:

a magnetic core formed by winding a magnetic alloy thin strip, which is made of Fe-based amorphous alloy or Fe-based nano-crystalline alloy, said magnetic core having a hollow portion in the vicinity of the center;

a resin package for sealing said magnetic core; and a lead line disposed to pass through the hollow portion of the magnetic core;

wherein a part of said lead line is exposed to the outside from said resin package to be used as an actual terminal.

16. An inductance element according to claim 15, wherein a magnetic core is formed by winding a magnetic alloy thin strip.

17. An inductance element according to claim 15, wherein a magnetic core is formed by laminating magnetic alloy sheets.

18. The inductance element according to claim 15, wherein said lead line is machined to be bent toward a substrate on which the exposed part is fixed.

19. The inductance element according to claim 15, wherein said thin strip is in one sheet.

* * * * *